United States Patent [19]

Krusche

[11] Patent Number: 4,669,151

[45] Date of Patent: Jun. 2, 1987

[54] METHOD FOR PROCESSING STAPLE FIBERS OR THE LIKE ON A ROLLER CARD OR THE LIKE

[75] Inventor: Peter Krusche, Aachen, Fed. Rep. of Germany

[73] Assignee: Hergeth Hollingsworth GmbH, Duelman, Fed. Rep. of Germany

[21] Appl. No.: 750,846

[22] Filed: Jul. 1, 1985

[30] Foreign Application Priority Data

Jul. 5, 1984 [DE] Fed. Rep. of Germany ..... 3424660

[51] Int. Cl.[4] ..... D01G 15/02

[52] U.S. Cl. ..... 19/98; 19/100

[58] Field of Search ..... 19/98, 99, 100, 101

[56] References Cited

U.S. PATENT DOCUMENTS 2,560,013 7/1951 Varga ..... 19/100

2,936,495 5/1960 Taine et al. ..... 19/100

OTHER PUBLICATIONS

*The Journal of the Textile Institute,* "The Distribution and Movement of Wool on Woolen Cards", by J. G. Martindale, Sep. 1945, pp. T213–T228.

*Primary Examiner*—Louis K. Rimrodt

*Assistant Examiner*—J. L. Olds

*Attorney, Agent, or Firm*—Cort Flint

[57] ABSTRACT

A method for processing staple fibers on a roller card including a carding cylinder and a plurality of working points provided at the periphery of the carding cylinder. Each working point is formed at a corresponding pair of worker rollers and clearer rollers. The method comprises circulating the fibers about the working points for different circulation times whose mutual ratios do not form integers; and rotating a working roller at a speed of between twenty meters per minute and ninety meters per minute.

4 Claims, 4 Drawing Figures

METHOD FOR PROCESSING STAPLE FIBERS OR THE LIKE ON A ROLLER CARD OR THE LIKE

Figure 1:
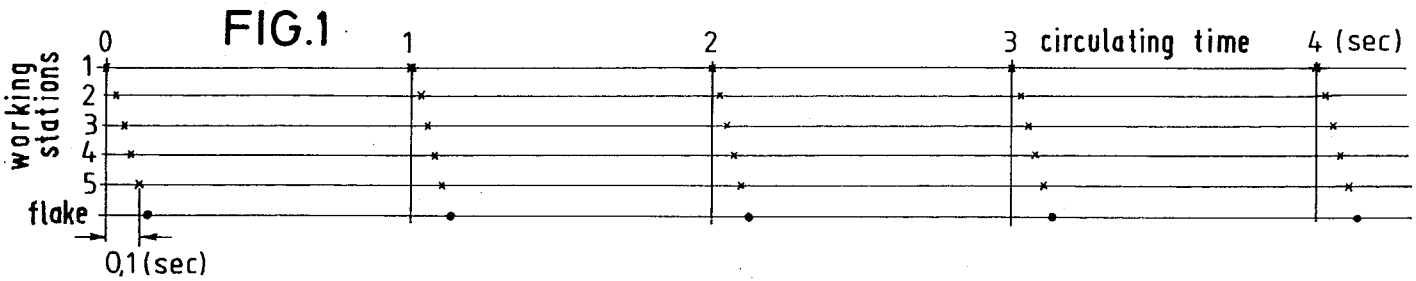

It has been known that the uniformity of a pile or web such as expexted from the laws of accident cannot be obtained by means of a roller card. The result that could be achieved may be calculated and determined with the Martindale formula, the ideal CBL (coefficient between lengths) curve and the ideal spectrogram curve.

The laws of accident in the card are generally disturbed in two respects, viz. first, by the feeding of the cards with fiber batches and coarse flocks and second, by the fact that all of the working rollers and clearer rollers are driven at the same speed each.

The following description shall deal with the reason for and the cooperation of the two factors.

Due to the high drum speed, the portions of a passing batch getting under the first working roller will appear nearly simultaneously under the other working rollers. Although the drum spreads apart said fibers, they appear as a nib on the doffer (fibrous web) because generally, the doffer speed is 10 to 40 times more slowly than that of the drum.

With the same speeds of the working roller and of the clearer roller, the batch portions running around the working points are moving at the same speed so that they again appear on the drum at the same moment and at exactly the same point of the clothing thus bringing about again a fiber accumulation. Portions of the quantity passed through again will form another nib in the web which nib is spaced from the first by the distance passed by the doffer in the time in which a flock has run around a working station.

Of course, the second nib is smaller than the first, the third being smaller than the second because said portions have passed a carding point to be spread there by one respective additional cycle.

In other words, the operations in the card are not stochastic—merely incidental—as desired. Therefore, it is an object to well open the fibers, to card them and to interfere with the disclosed rhythm.

It may be evidenced that the carding effect of a card is increased exponentially with the carding number Kz. Kz means the number of runs of a flock between the drum and the working roller where it is divided. The flock size FFz (number of fibers in a flock) which is just still opened to the individual fiber is $$FFz=(1/p^{Kz});$$

p being the portion of a flock not received by the working roller and running through accordingly. Said portion is always inferior to 1; the more fibers are circulated by the working roller in relation to the production of the card, the greater the decrease of p. However, the quantity circulated by the working roller will be increased, if it is driven at a higher speed. At about 90 m/min. three to 5 times of the production will be circulated so that p takes already the value of 0,2 to 0.3.

It is not absoultely necessary to make efforts to obtain higher speeds, because new problems will come up for the processing, e.g. the dusting problem. Much higher speeds have been suggested already.

The known method of reducing the driving wheels by one tooth from working roller to working roller and to vary stepwise the speeds will not do to decisively interfere with the rhythm set forth above. Such a variation or gradation only causes jumps of about 3% in case of the usual gear sizes of 30 teeth.

It is the object of the invention to improve safely and more reliably the uniformity of the fiber distribution in view of the proposed processing on a roller carding machine. According to the invention, it is suggested, contrary to the usual habits, to drive the working rollers and clearer rollers in such a way that various speeds are imparted to all working stations, that the circulating times of the flocks around the working station are as different as to ensure that their mutual ratios do not form integers, and preferably are so different that the lowest speed of a working roller is not inferior to 20 m/min and the maximum speed is not above 90 m/min. By this means, a reliable uniform distribution of a flock or of the fibers is obtained in the fibrous web.

According to another feature of the invention, the gradations of the rotating times of a flock around a working station shall not be more than 20%. The ratio between the speed of the quickest working roller and that of the drum shall be at least 1:13. Thus, the quality of a more uniformly carded fibrous web is ensured.

Figure 2:
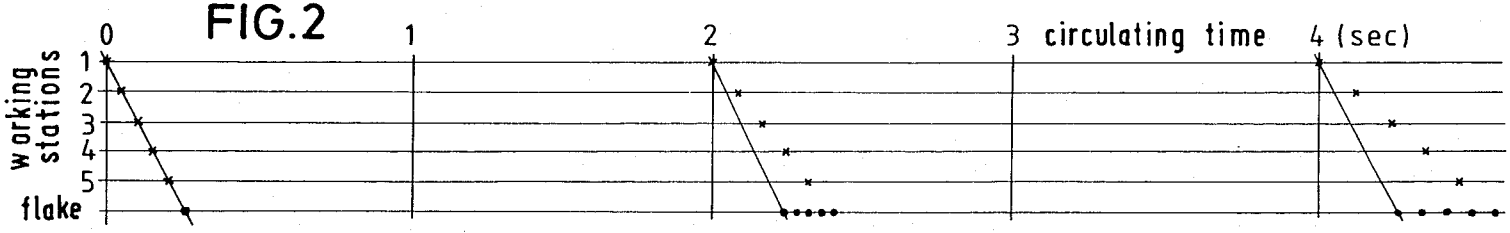
Figure 3:
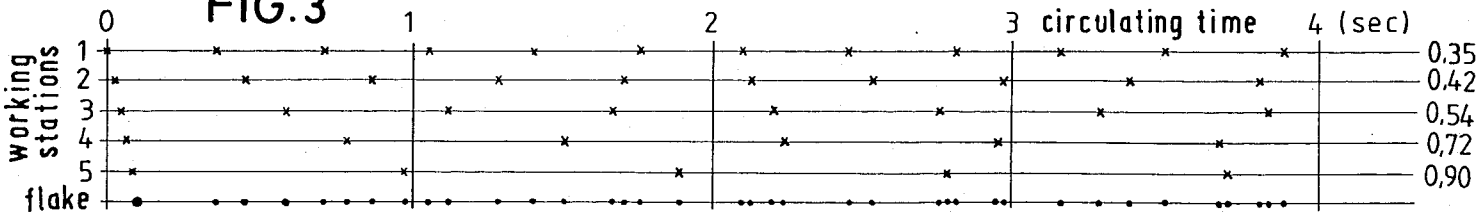

FIGS. 1 to 3 show the disclosed operations in a card having five working stations. The abscissa displays the circulating time of the flock in seconds, while the ordinate shows the number of working stations consisting of the working roller and the clearer roller. The diagrams show as to how a flock is processed.

FIG. 1 shows the working method of a card in which the drum moves in about 0,1 sec. to cover the distance from the first to the last working roller, the working stations conveying a flock in one second precisely. t=0 is the moment at which the flock has reached the first working roller. A dot means the passage of the flock through a carding point.

After 0,1 sec. the portion of the passing flock appears in the fibrous web (doffer). After another second, the second nib is formed, the third coming up after the next sec. etc. It will not suffice, in such a case to drive the working roller at a higher speed. While the carding effect is improved, the rhythm is not affected, it is only shorter.

FIG. 2 shows the case in which the drum is running at half the speed, the working stations requiring two seconds to cycle a flock, and the speeds of the working roller being decreased to be 3% more slowly. It may be clearly noted that the carding effect is reduced and that a flock is distributed but only slightly in the fibrous web. On the other hand, it is spread apart more widely from cycle to cycle as clearly evident from the positions of the dots in the fibre web after the second and fourth second.

FIG. 3 shows one of the possibilities of realising by graduated circulating times of the flocks about the working stations a carding drive according to the invention in view of a satisfactory processing and uniform distribution in the fibrous web of the flock. The times concerning the circulations of a flock around a working station vary from 0,35, to 0,42, 0,54, 0,72 and 0,9 seconds. This corresponds to the speeds of 90 m/min for the first working roller and of 75, 59,44 and 36 m/min for the following if the working rollers' diameter is 220 mm, while that of the clearer rollers is 105 mm. The speeds of the clearer rollers thus range between 450 and 150 m/min.

The three following examples are meant to explain the process of the invention. The working station at which the drum is operating consists of a working roller and of a clearer roller and tu (sec) designates the circulating time of a fiber around a working station formed by a working roller and a clearer roller. The examples refer to five working stations 1 to 5 operating with one common drum.

EXAMPLE 1

| Working Station | 1 | 2 | 3 | 4 | 5 |
|---|---|---|---|---|---|
| Circulating time tu (sec) | 0,6 | 0,72 | 0,90 | 1,17 | 1,55 |

EXAMPLE 2

| Working Station | 1 | 2 | 3 | 4 | 5 |
|---|---|---|---|---|---|
| Circulating time tu (sec) | 0,4 | 1,52 | 0,70 | 0,89 | 1,19 |

EXAMPLE 3

| Working Station | 1 | 2 | 3 | 4 | 5 |
|---|---|---|---|---|---|
| Circulating time tu (sec) | 0,35 | 0,42 | 0,54 | 0,72 | 0,90 |

The circulating times of the fibers around the working stations are such as to ensure that their ratios do not form integers, namely:

From Example 1:

$$\frac{tu\ 2}{tu\ 1} = \frac{0,72}{0,60} = 1,21$$

$$\frac{tu\ 4}{tu\ 3} = \frac{1,17}{0,90} = 1,27$$

From Example 2:

$$\frac{tu\ 3}{tu\ 2} = \frac{0,70}{0,52} = 1,34$$

$$\frac{tu\ 4}{tu\ 3} = \frac{0,89}{0,70} = 1,27$$

From Example 3:

$$\frac{tu\ 2}{tu\ 1} = \frac{0,42}{0,35} = 1,20$$

$$\frac{tu\ 5}{tu\ 4} = \frac{0,90}{0,72} = 1,25$$

No number of the circulating times will be repeated and their ratios are different from one another as well.

Figure 4:
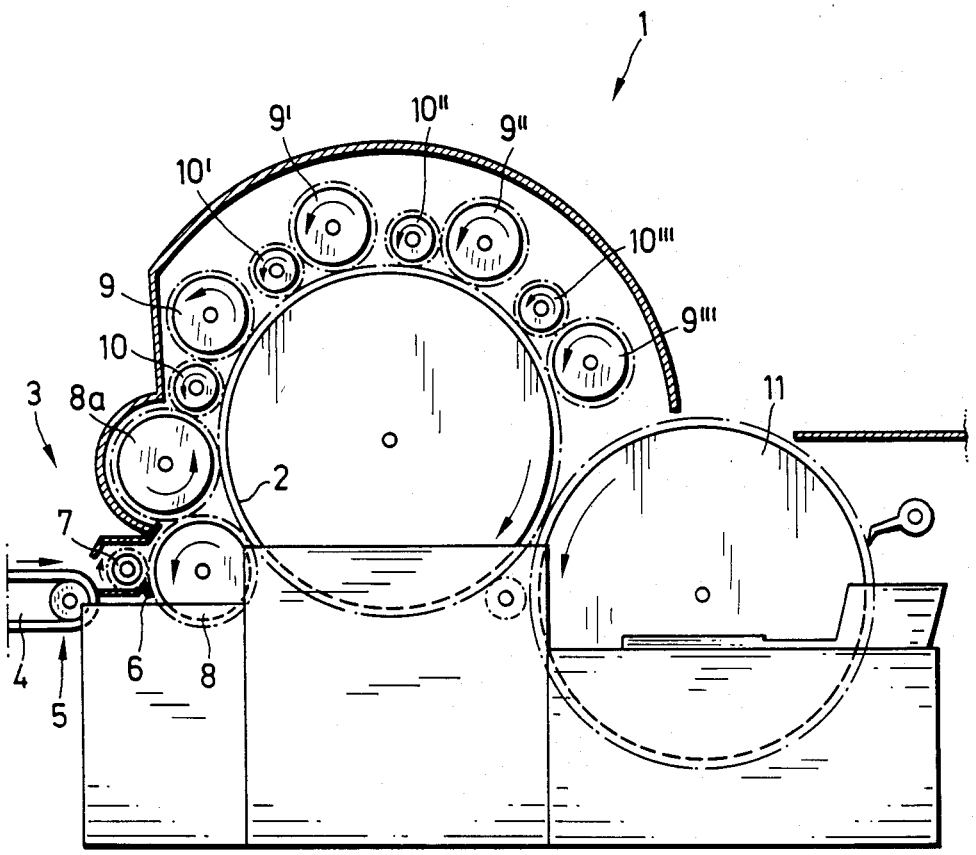

FIG. 4 illustrates a carding machine having a large carding cylinder or drum and working stations referred to above. Carding machine 1 comprises a carding cylinder or drum 2 having a large diameter. Intake means 3 is provided for taking in the material to be treated and includes an intake table 5 designed as a conveyor belt 4, a feed trough 6, and a feed roller 7, as well as a licker-in roller 8. Further, an additional roller 9 is provided above the licker-in roller 8 to inhibit filling up of the carding cylinder 2. The carding cylinder is provided with a number of worker and clearer roller pairs 9, 10, 9', 10', 9'', 10'', 9''', and 10''' which are followed by a doffer roller.

What is claimed is:

1. A method for processing staple fibers on a roller card which consists of a carding cylinder and a plurality of working points provided at the periphery of said carding cylinder, each working point being formed at a corresponding pair of worker rollers and clearer rollers wherein said method comprises:

(a) circulating the fibers about the working points for different circulation times whose mutual ratios do not form integers; and (b) rotating a working roller at a speed of between twenty meters per minute and ninety meters per minute.

2. The method according to claim 1 wherein said mutual ratios of the circulation times of the fibers of two working stations are different from one another.

3. The method of claim 1 or 2 wherein the circulation times of a flock about a working station are different in graduations of twenty percent or more.

4. The method of claim 1 wherein the ratio between the speed of the working roller which circulates the fastest and the speed of the carding cylinder is at least one to thirteen.

* * * * *